United States Patent [19]

Meldner

[11] 4,075,855

[45] Feb. 28, 1978

[54] TUNNEL CONSTRUCTION AND TUNNEL TUBBING

[75] Inventor: Volker Otto Meldner, Frankfurt am Main, Germany

[73] Assignee: Wayss & Freytag Aktiengesellschaft, Frankfurt am Main, Germany

[21] Appl. No.: 695,938

[22] Filed: Jun. 14, 1976

[30] Foreign Application Priority Data

Jun. 21, 1975 Germany ..... 2527743

[51] Int. Cl.[2] ..... E21D 11/05

[52] U.S. Cl. ..... 61/45 R; 52/396; 52/428

[58] Field of Search ..... 61/45 R, 84; 52/396, 52/428, 436

[56] References Cited

U.S. PATENT DOCUMENTS

| | | | |
|---|---|---|---|
| 1,969,810 | 8/1934 | McAlpine | 61/45 R |
| 2,687,034 | 8/1954 | Blanc | 52/396 X |
| 3,438,211 | 4/1969 | Zywietz et al. | 61/45 R |
| 3,695,044 | 10/1972 | Hoshino et al. | 61/45 R |
| 3,704,564 | 12/1972 | Koga | 52/428 X |
| 3,707,846 | 1/1973 | Leblond et al. | 61/45 R |

*Primary Examiner*—Jacob Shapiro

*Attorney, Agent, or Firm*—W. G. Fasse; W. W. Roberts

[57] ABSTRACT

A tunnel construction made of tubbings forming a lining or casing for a tunnel includes a plurality of contact points between adjacent tubbings. These contact points comprise adhesive material acting to connect adjacent tubbings to each other at predetermined points. The contact points are distributed around the circumference of the tubbing rings at predetermined locations which depend on the type of the tubbing used and also on the points of pressure application by the driving shield of a tunneling or heading machine. The present tubbings have recesses in their surface facing into the tunnel whereby the recesses have a substantially trapezoidal shape to form three ribs extending substantially in the direction of the longitudinal tunnel axes.

13 Claims, 5 Drawing Figures

(V-V)

TUNNEL CONSTRUCTION AND TUNNEL TUBBING

BACKGROUND OF THE INVENTION

The present invention relates to a tunnel construction and to tubbings used in such tunnel construction. Various types of tubbings are known in the art including steel reinforced concrete tubbings which are assembled into rings and the rings in turn are assembled to form the tunnel or rather the supporting tunnel tube.

The invention also relates to a tunnel construction using reinforced steel concrete tubbings wherein the individual tubbings in the rings are arranged in such a manner that the abutting joints of the tubbings of one ring are displaced relative to the abutting joints in the next adjacent ring. In other words, the ring built into the tunnel directly adjacent to the ring being built into the tunnel, has the joints between its tubbings angularly displaced relative to the respective joints of the adjacent ring whereby the angular displacement corresponds to a fixed distance. Normally, such a fixed distance will be equal to about one half the length of a tubbing.

In a so called shield tunneling machine, it is necessary to maintain the rings assembled from individual tubbings in position on the cylindrical tail end of the tunneling machine without the support provided by the surrounding earth or ground. This has resulted in difficulties because there is nothing holding the tubbings in place. In order to avoid such difficulties, it is known to secure the newly installed ring by means of screws to the ring already anchored in the ground. Such force transmitting screw connections require a precise fitting from ring to ring which in turn results in a rather substantial material and man hour expense.

It is also known to provide tongue and groove connections extending consecutively in the tubbings whereby adjacent rings mesh with each other. In this type of construction it is necessary to provide substantial play between the intermeshing parts in order to take into account practical construction considerations. Without such play it would not be possible to assemble the parts due to the unavoidable production tolerances. Such play between the tongue and groove in adjacent rings results in random contact points which in turn cause uncontrolled static conditions. Such uncontrolled static conditions are a substantial technical disadvantage, especially in tunnel tubes which must be constructed in a water tight manner. This is so because the uncontrolled static conditions may cause at certain points partial or localized overloads which in turn cause cracks.

OBJECTS OF THE INVENTION

In view of the foregoing, it is the aim of the invention to achieve the following objects, singly or in combination:

- to remove the drawbacks of the prior art outlined above, more specifically, to provide a tubbing and a respective tunnel construction in which the static conditions and the force distribution corresponds exactly to the computational assumptions which are made in calculating a tunnel construction;
- to provide a tunnel construction in which the installation of tubbings may be accomplished with a substantially reduced man hour and material expense;
- to provide points of contact between adjacent tubbings, and thus between adjacent tubbing rings, which points are located where forces are transmitted from one ring to another in accordance with static calculations;
- to provide a tunnel construction which is suitable for non-rigid or soft grounds or earth formations; and
- to provide a tubbing which has recesses in its surface facing into the tunnel so as to provide the tubbing with respective ribs extending in the direction of the longitudinal axes of the tunnel.

SUMMARY OF THE INVENTION

According to the invention there is provided a tunnel construction in which the individual tubbings forming adjacent rings are provided with contact points at predetermined locations to form a stiff tunnel tube. The location of the contact points and the manner of force transmission through these contact points is determined by static calculations and by the coefficients of the material employed for making these contact points. Thus, the contact points may be an adhesive such as concrete, preferrably foamed concrete or a bituminous binder composition, preferrably a bituminous binder composition including a filler and plasticizing component such as caoutchouc whereby the bitumen and plasticizer are preferably present in equal proportions.

The contact and force transmitting points are located at the abutting joints or interfaces between adjacent rings and it has been found that a tunnel construction thus stabilized is quite suitable for driving a tunnel through non-rigid ground formations.

According to the invention, there is further provided that the contact points project out of the contact areas at the abutting joints or interfaces of the tubbings in adjacent rings. Further, the contact points are made of plastically deformable materials and/or structures as described above, for example, of foamed concrete mortar or the like. The contact material is preferrably located at predetermined, calculated points around the circumference of the tubbing rings whereby free spaces are provided between adjacent points so that the contact material may be displaced into these free spaces when two adjacent tubbing rings are pressed against each other. However, in an alternative embodiment according to the invention, the contact material may be spread onto the entire surface of the interface between two adjacent tubbings.

BRIEF FIGURE DESCRIPTION

In order that the invention may be clearly understood, it will now be described, by way of example, with reference to the accompanying drawings, wherein.

Figure 3:
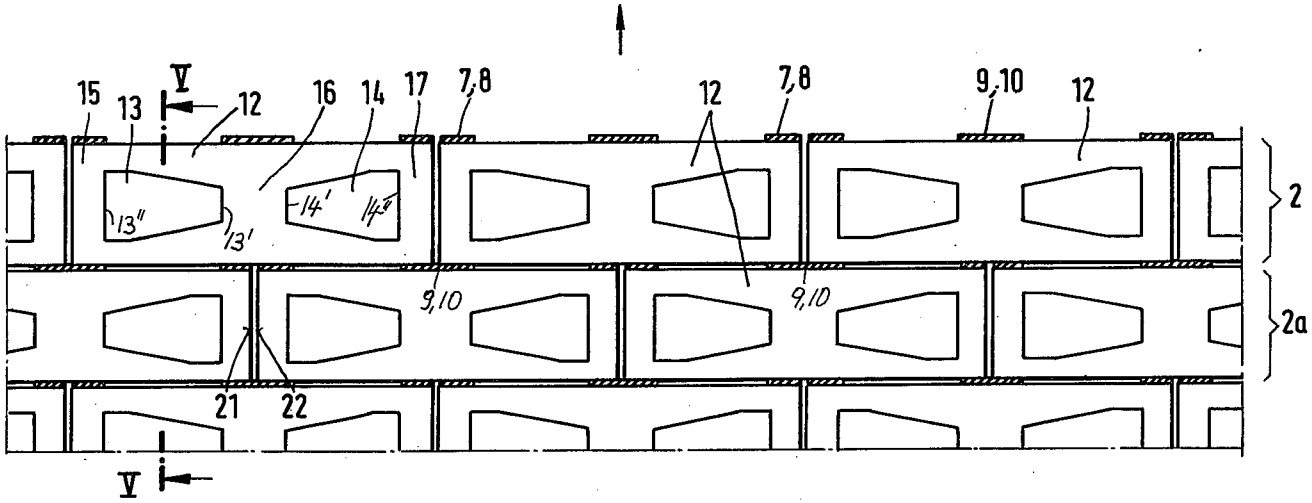
FIG. 3 shows the developed projection of a plurality of tubbing rings whereby the view is against the vault surface of the tubbings facing into the tunnel and wherein the individual tubbings are of the so called cassette type according to the present invention with the contact points shown in section.
Figure 4:
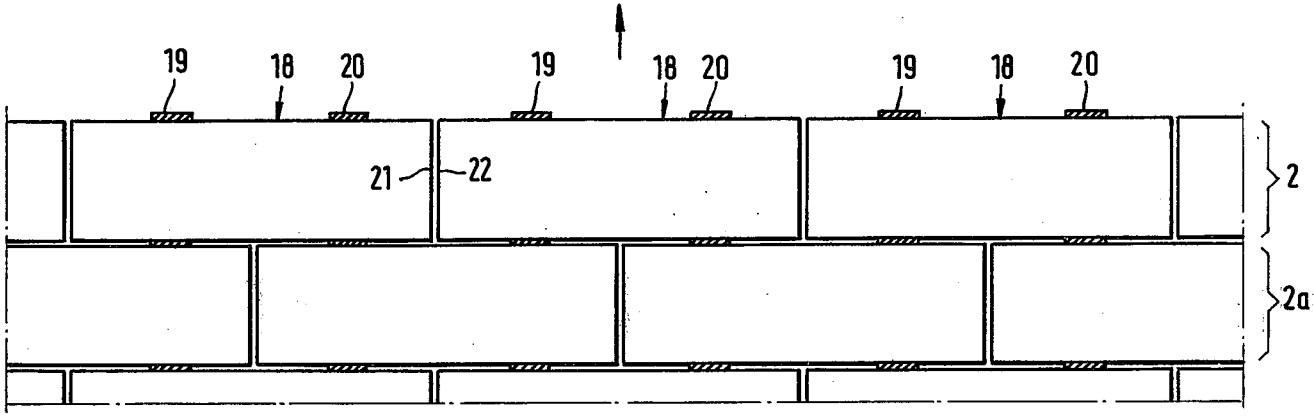
Figure 5:
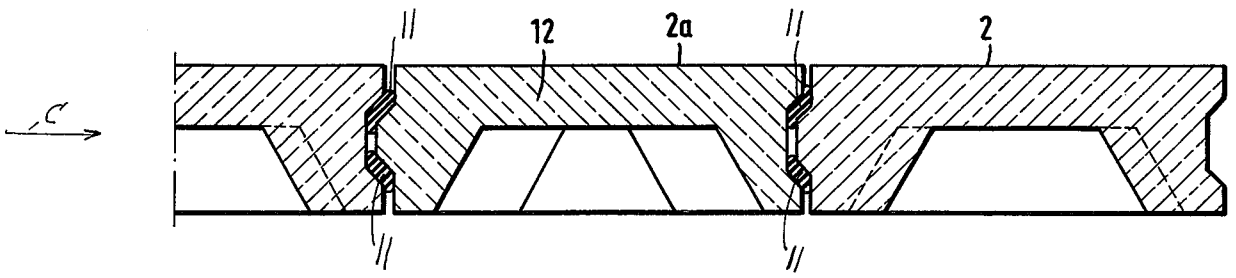

FIG. 4 shows a view similar to that of FIG. 3, however, the individual tubbings are of the so called full type and the locations of the contact points between adjacent tubbings differ from the locations shown in FIG. 3; and FIG. 5 is a sectional view along the section line V-V in FIG. 3 showing the section on a somewhat enlarged scale to illustrate the cassette type of tubbings according to the invention.

DETAILED DESCRIPTION OF EXAMPLE EMBODIMENTS

Figure 1:
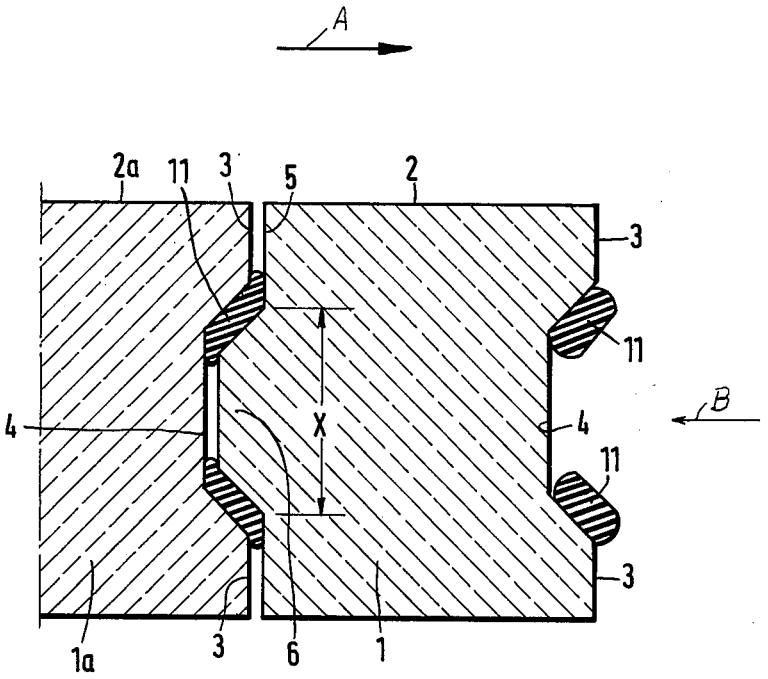
FIG. 1 is a sectional view through two adjacent tubbings whereby the sectional plane extends in the direction of the longitudinal tunnel axis, which direction is indicated by the arrow A.

Referring to FIG. 1 there is shown a section through two tubbings 1 and 1*a* forming respective tubbing rings 2 and 2*a*. The section extends in the plane of the longitudinal tunnel axis as shown by the arrow A. The rings 2, 2*a* and so forth form a casing or tunnel tube. Each tubbing is provided at its interface surface 3 with a groove 4. The respective opposite interface 5 of each tubbing is provided with a tongue 6 having a shape to substantially fit into the respective groove 4 but providing sufficient play. The circumferential length of the tongues 6 and their shape is adapted to the respective length of the groove. Moreover, the cross sectional shape of the tongues and the grooves is preferrably that of a trapezoid. The width "X" of a tongue 6 is somewhat smaller than the respective width of a groove 4 as shown in FIG. 1 to provide for said play.

Figure 2:
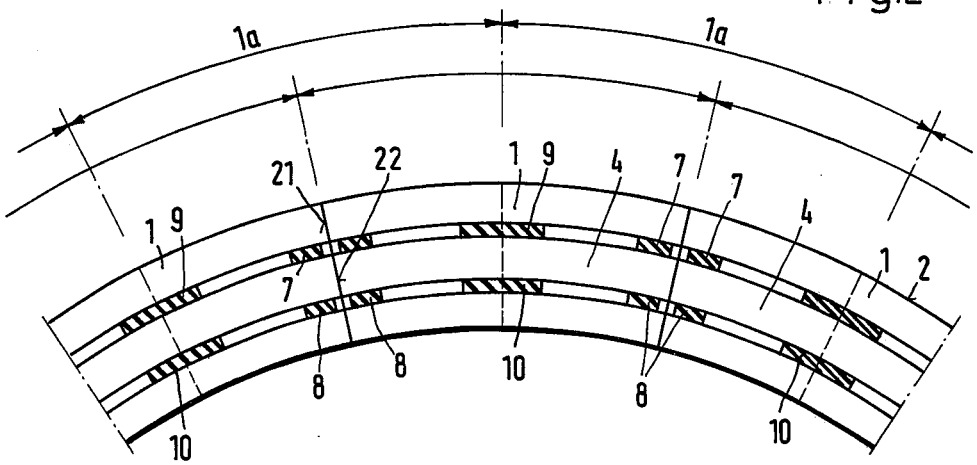
FIG. 2 is a somewhat schematic view against the interface of a plurality of tubbings forming a tubbing ring substantially in the direction of the arrow B in FIG. 1.

The tubbings 1, 1*a* of adjacent tubbing rings 2, 2*a* do not touch each other at the interface surfaces 3 and 5. According to the invention the contact between adjacent tubbings is provided at selected points 7 and 8 or 9 and 10 as best seen in FIG. 2. The contact points are formed by patches of plastically deformable material 11 as shown in FIG. 1. The contact material 11 may be inserted at the time of assembling the tubbings into respective rings or the contact material may be provided at the time of manufacturing the tubbings.

The contact material 11 may, for example, comprise a lump of bituminous binder material preferrably combined with a plasticizing or filler component such as caoutchouc. Such bituminous binder materials and filler plasticizers, for example, in the form of caoutchouc chips are well known in the art. The proportion of filler material in the form of caoutchouc chips to the proportion of bituminous binder material would preferrably be 50:50 in weight proportions. One suitable material for the contact points is known under the trade name "Kaubit" comprising the just mentioned mixture of caoutchouc chips and bitumen. This material is sold in bulk quantities by "Kaubit Chemie" of Dinslaken, West Germany.

Another suitable material for the plastically deformable contact points is, for example, a porous or foamed concrete mix comprising the following components which form one cubic meter of concrete mix:

1085 liters of polystyrofoam:

380 kilograms of cement (for example of the so called "Portland" type)

90 kilograms of sand having a grain size from very small dust particles to up to approximately 1 millimeter and, 140 kilograms of water. The foregoing ingredients are thoroughly mixed, and rolled out into plates of approximately 1 centimeter thickness. The plates are then cut down into platelets of approximately 10 by 10 centimeter size to be inserted at the above mentioned contact points. The just described mix or rather the platelets made from such mix have a density of 0.60 kg/dcm$^3$. A standard cube of this material has a strength of about 30 kg/cm$^2$. When the just described platelets are installed at the contact points 11, and the tunnel rings are pressed against each other, these contact points or platelets 11 are subjected to a load of about 60 kg/cm$^2$. This pressure reduces the volumn of the contact point platelets to about $\frac{1}{3}$ of their volumn prior to installation.

The contact points or rather the contact platelets 11 of a material as described above are distributed about the circumference of a tubbing ring in accordance with the particular construction of a tubbing. Thus, in the embodiment of FIGS. 1 and 2 the contact points 11 are located at the slanted portions of the grooves 4. As best seen in FIGS. 2 and 3, each tubbing is provided with 6 contact points at each interface, namely, two points 7, two points 8, and the points 9 and 10 whereby two points are located opposite each other in the same groove 4 as best seen in FIGS. 1 and 2.

Referring specifically to FIG. 2 it will be noted that the contact points or rather contact areas 9 and 10 have a length corresponding to about twice the length of the contact points 7 and 8. The longer contact areas 9 and 10 are located centrally between the ends of a tubbing, whereas the shorter contact points 7 and 8 are located at the ends of the respective tubbing. The spacing between the contact points 7 and 9, and 8 and 10 corresponds to about $\frac{1}{2}$ the length of a tubbing. Thus, the contact between tubbings 1, 1*a* forming the adjacent rings 2, 2*a* is accomplished at three predetermined or selected double points. This arrangement of the contact points is especially suitable for so called cassette tubbings according to the invention as shown in FIG. 3.

Referring to FIG. 3, the cassette tubbings 12 according to the invention have two recesses 13 and 14 substantially in the shape of a trapezoid facing into the tunnel. The shorter ends or sides 13' and 14' of the respective trapezoids face toward each other, that is, inwardly so as to form a rib 16. The longer ends 13" and 14" face outwardly thus forming ribs 15 and 17. This structure provides each tubbing 12 with three ribs 15, 16, and 17, extending substantially in parallel to the longitudinal axis of the tunnel whereby the central rib 16 has preferrably a width corresponding to about twice the width of one of the outer ribs 15 or 17.

It is advantageous to place the contact points 7, 8, or 9, 10 and 7, 8 as shown in FIG. 3 for a cassette tubbing 12, whereby the contact points are located in register with the ribs 15, 16 and 17. This arrangement is especially advantageous because the contact points are located where the pressing devices of a shield tunneling or heading machine will be effective when assembling the tunneling rings or tubes so that the longitudinal forces will be transmitted through the contact points to the ribs 15, 16, and 17.

Where so called full tubbings 18 are used as shown in FIG. 4, it is advantageous to provide each interface with two contact points 19 and 20. The contact points in 19 and 20 in FIG. 4 are located at the slanted portions of the grooves 4 as shown in FIG. 1. The spacing between the contact points 20 and the respective end faces 21 or the contact points 19 and the corresponding end faces 22 of the tubbing correspond to approximately $\frac{1}{4}$th of the entire length of one tubbing 18.

When the pressure applying devices of a tunneling machine press the tubbings 1 or 12 or 18 of the ring 2 presently being constructed against the ring 2*a* already completed, the material 11 in the grooves 4 is compressed and flows somewhat along the length of the grooves thereby establishing a force transmitting connection at precisely defined points between two neighboring tubbing rings. The compression of the contact points 11 is best seen in FIG. 5 whereby the force pressing the tubbing rings together is indicated by the arrow C.

From FIGS. 2, 3 and 4 it will be noted that the tubbings in one ring 2 are angularly displaced relative to an adjacent ring 2*a*. Preferrably, the displacement is such that the joint or gap between two facing ends 21, 22 are displaced by about ½ the length of a tubbing so that the center of the tubbings in one ring coincide substantially with the joints between the tubbings in the adjacent ring. In this connection it will be appreciated that the contact points 9 and 10 face respectively two contact points 7 and 8 so that the circumferential length of the contact points 9 and 10 should be about twice the respective length of the contact points 7 and 8.

However, it will be appreciated that the position and arrangement as well as the width and length of the contact points will depend on the particular type of tubbing used and on other considerations such as the points where the pressure application means of the tunneling machine are located.

Although the invention has been described with reference to specific example embodiments, it will be appreciated, that it is intended to cover all modifications and equivalents within the scope of the appended claims.

What is claimed is:

1. A tunnel construction having a longitudinal axis, comprising a plurality of tubbings forming a number of rings arranged side by side along said longitudinal axis, said rings having interfaces between adjacent rings, connecting contact means inserted between said interfaces between tubbings of adjacent rings, said connecting contact means providing the only force transmitting connections between the tubbings of adjacent interconnected tubbing rings, said connecting contact means being located at calculated, predetermined points along said interfaces between the tubbings of adjacent rings, whereby the force transmission between adjacent rings is localized at said predetermined points.

2. The tunnel construction according to claim 1, wherein said connecting contact means comprise plastically deformable materials projecting from said interfaces substantially in the axial direction of the respective tunnel.

3. The tunnel construction according to claim 2, wherein said interfaces between adjacent rings comprise tongue and groove means, said connecting contact means being located in the groove of said tongue and groove means at predetermined locations therealong.

4. The tunnel construction according to claim 3, wherein said groove means comprise free spaces between adjacent connecting contact means, whereby said connecting contact means are squeezed into said free spaces when said tubbing rings are pressed together.

5. The tunnel construction according to claim 1, wherein tubbings forming adjacent rings comprise tongue and groove means facing substantially in the axial tunnel direction, said defined contact points being located in the groove of said tongue and groove means.

6. The tunnel construction according to claim 5, wherein said groove has a cross-section corresponding to that of a trapezoid having outwardly facng slanted sides, said defined contact points being located on said slanted sides.

7. The tunnel construction according to claim 1, wherein said defined contact points are located around said interfaces at locations suitable for pressure application by the driving shield of a tunneling machine.

8. The tunnel construction according to claim 1, wherein said connection contact means comprise concrete which is plastically deformable.

9. The tunnel construction according to claim 1, wherein said connecting contact means comprise a bituminous binder material which is plastically deformable.

10. The tunnel construction according to claim 1, wherein each individual tubbing comprises recesses in its surface facing into the tunnel, said recesses having a substantially trapezoidal shape, said recesses having narrower ends facing toward each other.

11. The tunnel construction according to claim 10, wherein each individual tubbing comprises three ribs extending substantially in the axial direction of the tunnel, on its surface facing into the tunnel, said ribs extending substantially in parallel to each other.

12. The tunnel construction according to claim 11, wherein said three ribs include a central rib and two outer ribs, said central rib having a width about twice the width of each outer rib.

13. The tunnel construction according to claim 10, wherein each tubbing comprises at least two substantially trapezoidal recesses in said inwardly facing surface, said two substantially trapezoidal recesses having narrower ends facing toward each other.

* * * * *